US007013598B2

(12) United States Patent
Powless

(10) Patent No.: US 7,013,598 B2
(45) Date of Patent: Mar. 21, 2006

(54) RETAINER FOR PREVENTING TIPPING OF FLOWER POT

(76) Inventor: Theresa N. Powless, 875 Brandon Ave., Pontiac, MI (US) 48340

( * ) Notice: Subject to any disclaimer, the term of this patent is extended or adjusted under 35 U.S.C. 154(b) by 0 days.

(21) Appl. No.: 10/716,208

(22) Filed: Nov. 18, 2003

(65) Prior Publication Data

US 2005/0102898 A1 May 19, 2005

(51) Int. Cl.
*A01G 9/02* (2006.01)

(52) U.S. Cl. ..... 47/39; 47/47

(58) Field of Classification Search ..... 47/33, 47/65.5, 73–75, 77, 78, 39, 41.01, 44, 46, 47/47, 41.1, 41.14, 66.7, 83; 248/154, 146, 248/148, 156

See application file for complete search history.

(56) References Cited

U.S. PATENT DOCUMENTS 600,506 A * 3/1898 Blake et al. ..... 248/500
1,421,327 A * 6/1922 Waters ..... 47/41.01
2,261,326 A * 11/1941 Atkisson et al. ..... 47/41.13
2,505,885 A * 5/1950 Davis, Jr. ..... 248/508
2,513,461 A * 7/1950 Duncan, Jr. ..... 248/154
2,803,418 A * 8/1957 Smith ..... 248/153
2,959,387 A * 11/1960 Ficek ..... 248/149
3,266,188 A * 8/1966 Budd ..... 47/29.6
3,273,841 A * 9/1966 Cota ..... 248/154
4,647,491 A * 3/1987 Ireland et al. ..... 428/137
5,836,105 A * 11/1998 Loosen ..... 47/39

FOREIGN PATENT DOCUMENTS

JP 409308379 A * 12/1997

* cited by examiner

*Primary Examiner*—Son T. Nguyen
(74) *Attorney, Agent, or Firm*—Harness, Dickey & Pierce, P.L.C.

(57) ABSTRACT

Providing a flower pot, which is rested upon the ground and which may be subjected to lateral forces which could tip the pot, with a retainer in the form of an elongated, vertically arranged, wire rod having an upper portion bent into a downwardly opening hairpin-like hook shape for grasping the upper edge portion of the wall of the pot and a lower stem portion of sufficient length to extend downwardly along the side of the pot and into the ground adjacent the pot. The retainer may be manually inserted into the ground, next to the pot wall, with its upper bent end receiving and gripping the upper edge of the pot wall for holding the pot against tipping.

5 Claims, 1 Drawing Sheet

RETAINER FOR PREVENTING TIPPING OF FLOWER POT

BACKGROUND OF THE INVENTION

This invention relates to a method and retainer device for holding a conventional flower pot, which is rested upon the ground, from tipping over accidentally. Conventional flower pots, which are made of plastic materials or clay or the like, that are filled with potting material or dirt and hold flowers or other plant materials, are prone to tipping over when subjected to wind or other relatively low, laterally applied forces. Thus, it would be desirable to provide a simple, inexpensive, device which holds a flower pot against falling over on its side.

Devices for stabilizing or holding a flower pot have been developed in the past. An example of such a device is disclosed in U.S. Pat. No. 5,836,105 issued Nov. 17, 1998 to Ronald E. Loosen for "Nursery Pot Stabilizing Device." That device involves a flower pot holder which has a base that is provided with openings. Hooks with upper ends that engage the holder base through its openings, extend into the ground to hold the pot in place upon the ground. However, a device of that sort is relatively expensive and cumbersome in use and is not useful with conventional flower pots. That is, it is not practical or sufficiently inexpensive for use with a substantial number of ordinary clay or plastic flower pots that are typically provided by retail plant sales establishments. Such conventional pots, containing plants, are commonly placed on the ground near homes, cemetery grave sites, and other places for temporary display of potted flowers.

Other more elaborate constructions have been used to hold a flower pot upon the ground and to prevent the pot from tipping over. Further examples of such devices are illustrated in U.S. Pat. No. 1,902,423 issued Mar. 21, 1933 to W. H. Seltzer for "Flower Holding Device"; U.S. Pat. No. 5,279,070 issued Jan. 18, 1994 to Jerald C. Shreckhise for a "Plant Growing Receptacle and Method"; U.S. Pat. No. 2,861,764 issued Nov. 25, 1958 to Delphis Fisher for a "Receptacle Holder"; U.S. Pat. No. 1,846,433 issued Feb. 23, 1932 to Percival F. Morley for a "Flower and Plant Holder"; French Patent No. 2,557,761, published Jul. 12, 1985, to Daniel Naas for a device for stabilizing flower pots; French Patent No. 2,481,881, published Nov. 13, 1981, to André Franclet, illustrating a flower pot retaining device for holding a pot upon the ground; French Patent No. 1,148,341, published Dec. 6, 1957, to M. Jean-Xavier Dagnaud for a holder for vases and pots.

Each of the devices disclosed in the foregoing patents are relatively expensive, particularly where a large number of them may be needed for temporarily holding a considerable number of flower pots at one time. These prior devices are formed to support a single-size pot. Since flower pots of different shapes and sizes are common, an inventory of retainers of different sizes would be needed for holding an assortment of different size pots. That is, the devices disclosed above, in general, lack the ability to hold pots of different sizes within a wide range of sizes. Hence, it would be desirable to have a simplified, very inexpensive, retainer which may be used on an assortment of different size and shape flower pots, within wide ranges of sizes, to securely hold a flower pot upon a ground surface against tipping over under the influence of wind or relatively small forces applied laterally against the pots or the portion of the plants that extend upwardly from the pots.

SUMMARY OF THE INVENTION

The present invention contemplates a simplified retainer and a method for applying the retainer for immobilizing a conventional flower pot rested upon a ground surface. The device comprises an elongated stem or rod having an upper end which is bent into a downwardly opening, hairpin-like shape which fits over and resiliently grasps an upper edge portion of the rim of a conventional flower pot. The stem is intended to extend downwardly from the rim of the pot, along the side wall of the pot, into the ground for a sufficient depth that will enable the retainer to stabilize the pot. A single retainer, in many instances, would be sufficient to hold a pot against tipping. However, in instances where a single retainer is not enough, due to the size or shape of the pot or the exposure to wind or other forces, two retainers may be used. For example, retainers may be positioned on diametrically opposite sides of the pot. The springy hairpin-like shape of the upper end of the retainer enables it to be utilized with various wall thicknesses and enables the retainer and the pot to stay together notwithstanding the forces applied against the pot or its contents.

An object of this invention is to provide an extremely inexpensive retainer in the form of a stiff, wire-like rod of sufficient length to extend into the ground alongside a pot while its upper end is bent into a downwardly opening hairpin-like hook which clips over and grips an upper portion of the rim area of the pot to hold the pot against tipping. The free end of the hook may be inserted into the potting material that is in the pot so as to grip the adjacent portion of the interior surface of the pot wall.

Still another object of this invention is to provide a simplified retainer manufactured from a length of wire-like metal whose upper end is bent downwardly into a hook-shape for gripping the upper edge of a pot, and whose lower end is sufficiently pointed or beveled to extend into the ground so that the retainer can be positioned alongside the wall of the pot.

These and other objects and advantages of this invention will become apparent upon reading the following description, of which the attached drawings form a part.

DETAILED DESCRIPTION OF THE PREFERRED EMBODIMENTS

Figure 1:
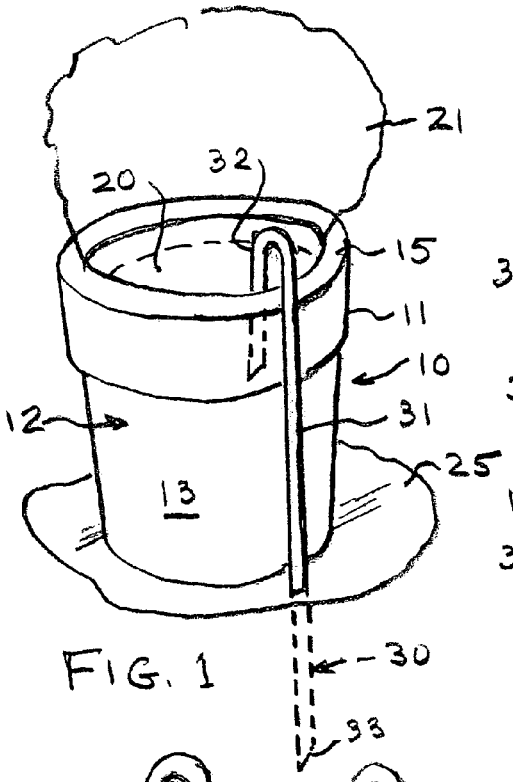
FIG. 1 is a perspective view illustrating a retainer attached to a conventional flower pot rested upon the ground. Plant material, schematically shown in dotted lines, extends upwardly from the pot.

Referring to the drawings, which illustrate preferred embodiments of this invention, a conventional flower pot 10 is illustrated as resting upon the ground. The pot may be made of a plastic material or of a conventional clay material or sheet metal or in some cases cardboard-like composition material. The particular shape and size of the flower pot and the material of which it is made, is not part of this invention and may vary.

Figure 2:
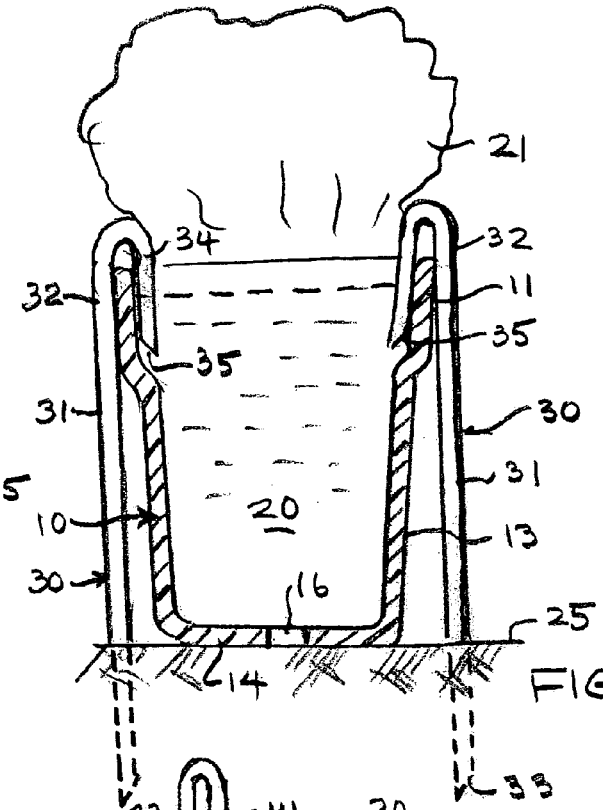
FIG. 2 is a cross-sectional view of the pot, rested upon the ground, showing a pair of retainers, one on each diametrically opposite side of the pot for holding the pot.

The pot illustrated in FIG. 1 and FIG. 2 is provided with a conventional upper rim band 11, that is a widened or substantially cylindrically shaped band formed at the upper part of the pot. The lower part of the pot is formed with a body portion 12 that, conventionally, is tapered downwardly and inwardly. Thus, the lower part of the pot is formed by the tapered wall 13 and a closed base 14. The upper edge of the pot is provided with a rim 15. The base may have one or more holes 16 for draining water from the pot (see FIG. 2).

The pots illustrated in the drawings are filled with potting material or dirt 20 and contain a plant 21 which is schematically illustrated. The plant may be a flower plant or a number of flower plants or a bush or other plant types of materials commonly sold in flower pots.

It is contemplated that the flower pot will be rested upon the ground 25 which would comprise earth or pebbles or such other penetrable material. By way of example, it is common to provide flowers potted within small flower pots, at grave sites in cemeteries for various occasions (such as the deceased's birthday, anniversary of their death, mother/father's day, Christmas, etc.). Another common use of potted flowers and small flower pots in outdoor settings is around garden areas or areas around houses or other buildings where the flowers or plants are temporarily positioned in their pots and are replaced periodically.

In each of these uses, the flower pots, which may be relatively small, are rested upon the ground and are subjected to wind pressures or physical disturbances or inadvertent physical forces which may tip the pots over on their sides.

Figure 3:
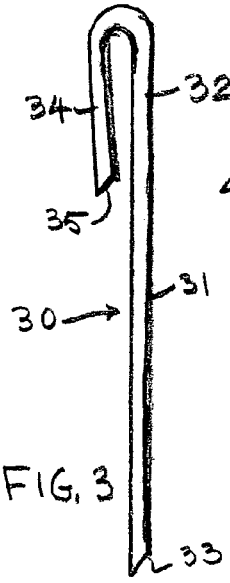
FIG. 3 illustrates a retainer per se.

The retainer 30, as illustrated in FIG. 3, for example, comprises an elongated stem or rod 31 which may be made of a metal wire, such as steel or aluminum wire, which is relatively rigid. The upper end of the retainer is bent into a downwardly opening hairpin-like hook 32. Preferably, the metal forming the retainer is somewhat resilient. Thus, the hook may be resiliently forced over the rim of the pot for gripping the rim between the legs defining the hook shape.

The lower end of the stem is preferably formed with a sharpened or pointed end portion 33 which assists in penetrating the ground or pebbles or other ground-forming materials when the retainer is pushed downwardly into the ground. Also, the free end of the outer leg 34 of the hook 32 may be formed with a sharpened or pointed end 35 which assists in penetrating the potting material when the retainer is pushed downwardly for gripping the upper edge portion of the pot.

Figure 4:
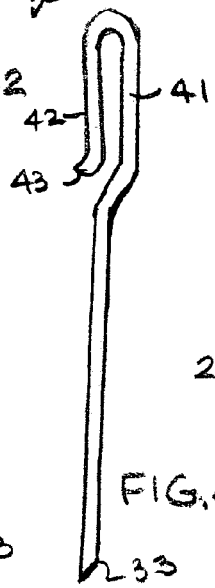
FIG. 4 illustrates a modified form of the retainer having its upper end bent to more closely engage a band-type rim portion which is formed on some conventional flower pots.
Figure 5:
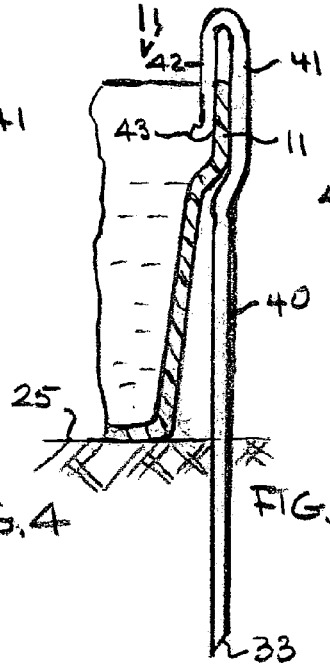
FIG. 5 is a fragmentary, cross-sectional illustration illustrating the retainer of FIG. 4 engaged with and holding a flower pot of the type having a band-type rim portion.

FIG. 4 and FIG. 5 illustrate a modified shape of the retainer 40 wherein the upper portion 41 of the stem is bent offset of the main body of the stem to more closely accommodate the shape of the rim band found on many types of flower pots. The outer leg 42 is bent downwardly at a small angle towards the upper portion of the stem to form the hairpin-like bent shape. The free end of the outer leg 42 may be provided with a slightly outwardly curved bent end portion 43 for easily slipping over the edge of a pot. Such a bent end portion may be used on the free end of the retainer of FIG. 3, instead of the sharp or pointed end 35 mentioned above.

Preferably, the outer leg forming the hook-like bend extends at a small angle toward the adjacent stem portion and the wire or rod material is somewhat resilient. Therefore, when the hairpin-like bend is positioned over the rim portion of the pot and the free end of the hook penetrates the contents of the pot, the hook tends to resiliently grasp the rim portion of the pot for tightly fastening together, by friction and spring force, the retainer and the pot.

Figure 6:
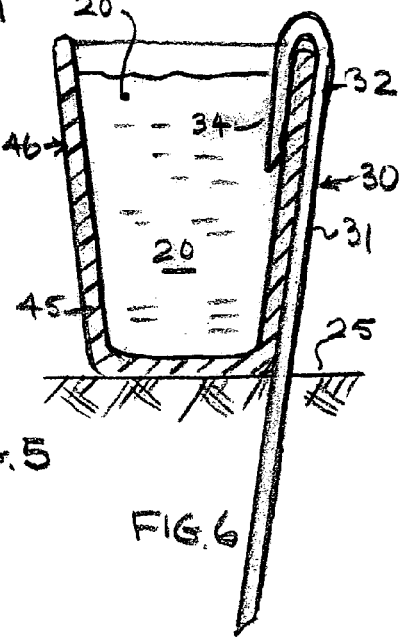
FIG. 6 is a cross-sectional view showing another form of flower pot which is made with straight sidewalls, that is without the rim band, held upon the ground by a retainer of the type illustrated in FIG. 3.

It is preferred that the hook portion be extended in length sufficiently so that it may be pushed downwardly, when engaging the rim portion of the pot, far enough to receive the rim portion, but not necessarily to the point where the entire hook portion is filled by the rim. As can be seen schematically in the drawings, in FIGS. 1, 2 and 5, the hook portion only partially receives the rim portion of the pot while still penetrating the contents of the pot. FIG. 6 illustrates the rim portion substantially filling the hook portion. That allows the user to adjust the depth that the retainer fits into the pot and fits into the ground adjacent the pot wall. Thus, the retainer will accommodate various pot heights and heights of the pot-filling material.

FIG. 6 illustrates schematically a modified, conventional pot 45 which has a straight wall 46, that is, it does not have the rim band commonly found on many other conventional pots. The retainer is shown with its hook 32 portion almost completely filled by the edge portion of the pot and the stem 31 of the retainer extending downwardly closely adjacent the sloped wall of the pot.

As indicated by the drawings, it is contemplated to use a single retainer for most situations. The retainer may be arranged vertically alongside the wall of the pot, as illustrated in FIG. 2 or at an angle, closely adjacent the wall of a pot as illustrated in FIG. 6. However, there may be situations where the external forces, such as high winds, or where a relatively tall pot or a pot with tall plants extending above it is used, so that the pot may be easily tipped over. In those situations it may be desirable to use a pair of retainers on opposite sides of the pot as illustrated in FIG. 2 or even one or more retainers in addition to two retainers.

This invention may be further developed within the scope of the following claims.

I claim:

1. A method for preventing tipping of a flower pot formed of an open top container having a generally vertical wall formed with an upper edge portion and having a substantially closed bottom for resting the pot upon the ground in an area where the pot may be subjected to lateral forces, which can tip the pot, comprising:

providing a retainer of a thin, bendable, but relatively stiff wire rod, formed in the shape of a vertically-elongated, substantially straight, unbent, stem portion and with the stem portion having an upper end portion bent downwardly into a hairpin-like formation to form a downwardly opening, inverted U-shaped hook portion and extending at an angle toward the adjacent stem portion; with the hook portion having one leg formed by the stem portion, and having a short leg for extending downwardly adjacent the stem portion, with the leg portions being spread apart for holding the wall upper edge portion between them while the short leg may extend downwardly into the pot and into any potting material contained in the pot while the substantially straight, unbent, stem portion extends downwardly alongside of the pot and continuing for a distance relative to the pot for extending into the ground;

resting the pot upon a ground surface;

engaging the hook portion over the upper edge portion of the pot and resiliently grasping the rim portion for tightly fastening together and extending the rod downwardly from the hook portion closely adjacent to the outside surface of the pot wall while the pot is resting upon the ground surface and pushing the stem portion downwardly alongside of the pot and continuing for a distance relative to the pot so that a lower portion of the stem portion enters into the ground a sufficient distance to hold the pot against tipping.

2. A method as defined in claim 1, and said wire rod being formed of a relatively resilient wire material, and arranging the hook portion to receive and resiliently grab the upper edge portion of the pot wall between the legs of the hook portion.

3. A method as defined in claim 1, and including providing a second retainer, similar in shape to said first mentioned retainer, and engaging the hook portion of the second retainer with the upper portion of the pot wall at a location spaced from the first mentioned retainer and then into the ground for temporarily holding the pot in a fixed position upon the ground at spaced-apart locations.

4. A method as defined in claim 1, and wherein said pot has a downwardly tapered wall, and including arranging the stem closely adjacent to the side wall of the pot, at an angle corresponding to the angle of the pot wall.

5. A method as defined in claim 1, and with said hook portion including pushing said short leg downwardly into polling material contained in the pot when engaging the hook portion over the upper edge portion of the pot while the stem lower portion enters into the ground.

* * * * *